United States Patent [19]

Tiefenthaler

[11] 4,278,619

[45] Jul. 14, 1981

[54] STEAM THROTTLE VALVE

[75] Inventor: Edelbert Tiefenthaler, Elgg, Switzerland

[73] Assignee: Sulzer Brothers Ltd., Winterthur, Switzerland

[21] Appl. No.: 179,963

[22] Filed: Aug. 21, 1980

[30] Foreign Application Priority Data

Sep. 5, 1979 [CH] Switzerland ..... 8012/79

[51] Int. Cl.[3] ..... B01F 3/04

[52] U.S. Cl. ..... 261/62; 122/487; 261/64 R; 261/115; 261/117; 261/118; 261/DIG. 13

[58] Field of Search ..... 261/62, 64 R, 76, 78 A, 261/115–118; 122/487

[56] References Cited

U.S. PATENT DOCUMENTS

| | | | |
|---|---|---|---|
| 1,526,041 | 2/1925 | Bancel | 261/DIG. 13 |
| 3,219,325 | 11/1965 | Brown | 261/DIG. 13 |
| 3,220,708 | 11/1965 | Matsui | 261/DIG. 13 |
| 3,287,001 | 11/1966 | Harris | 261/DIG. 13 |
| 3,331,590 | 7/1967 | Battenfeld et al. | 261/DIG. 13 |
| 3,719,524 | 3/1973 | Ripley et al. | 261/DIG. 13 |
| 3,732,851 | 5/1973 | Self | 261/DIG. 13 |
| 3,981,946 | 9/1976 | Soya et al. | 261/DIG. 13 |
| 4,011,287 | 3/1977 | Marley | 261/DIG. 13 |
| 4,071,586 | 1/1978 | Seger | 261/62 |

FOREIGN PATENT DOCUMENTS

| | | | |
|---|---|---|---|
| 1526977 | 3/1970 | Fed. Rep. of Germany | 261/DIG. 13 |
| 2443207 | 3/1976 | Fed. Rep. of Germany | 122/487 |

*Primary Examiner*—Richard L. Chiesa
*Attorney, Agent, or Firm*—Kenyon & Kenyon

[57] ABSTRACT

The steam throttle valve has a number of water injection ducts distributed around the valve axis within a thin-walled hollow member which extends around the valve axis. A thin-walled water supply duct in a bore in the valve casing cover supplies water to the hollow member. The member is annular and is retained between two assembled parts of the valve, namely the cover and a valve cage. Constructing the ducts in this way obviates thermal stress cracking near them.

9 Claims, 1 Drawing Figure

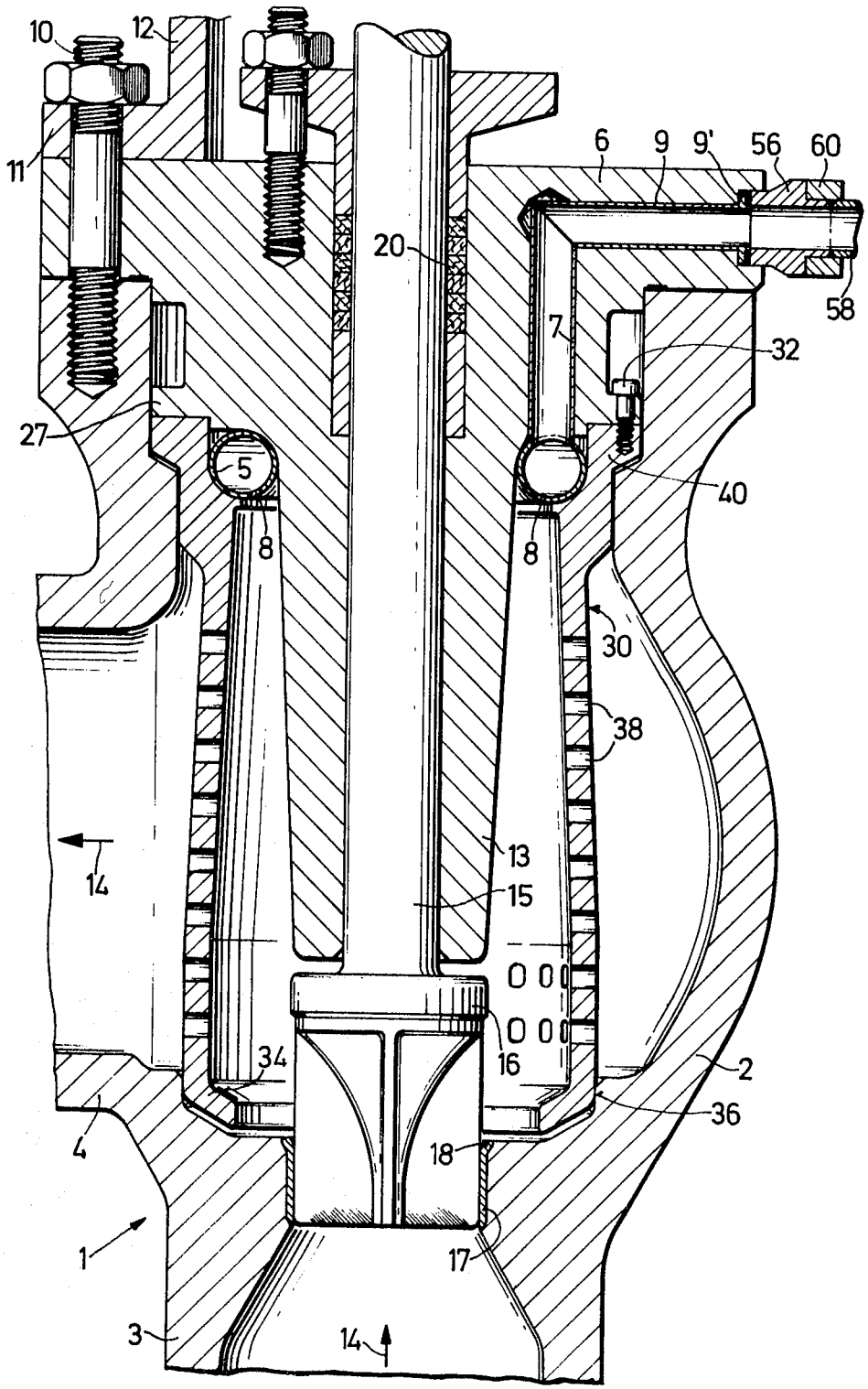
10
12
11
6
9
9'
56
60
20
58
7
32
27
5
40
8
8
30
38
13
14
15
16
34
2
36
4
18
1
17
3
14

STEAM THROTTLE VALVE

This invention relates to a steam throttle valve. More particularly, this invention relates to a caged steam throttle valve having water injection ducts therein.

Heretofore, it has been known, for example, as described in German A.S. No. 15 26 977, to construct a steam throttle valve with a valve cage downstream of a throttle cross-section and with a cooling water discharge zone which leads into a flow chamber between the throttle cross-section and openings in the valve cage. It has also been known to dispose a plurality of water injection ducts around the valve axis downstream of the throttle cross-section to inject water into a flow of steam passing through the valve. In order to ensure that a valve of this kind provides a uniform distribution of the injected water in the steam, it has been known to provide a number of water injection ducts around the axis of the valve in relatively thick-walled casing parts. However, if water starts to be supplied abruptly through the water injection ducts when steam is flowing through the valve, there is a very abrupt local temperature drop in the casing part which carries the water injection ducts. Thus, a risk of high thermal stresses occurring near such ducts exists. These thermal stresses may cause cracking, particularly near the duct orifices, and the cracks may extend from one duct to another. Cracking also occurs frequently in cases in which the injected water is cooled in long lines before entering the valve.

Accordingly, it is an object of the invention to avoid thermal stresses in the water injection ducts of a steam throttle valve in a structurally simple manner.

It is another object of the invention to provide a simple steam throttle valve construction which can be supplied with cooling water while avoiding thermal stress cracking.

Briefly, the invention is directed to a steam throttle valve having a valve body formed with a steam inlet port and a throttle cross-section on a valve axis downstream of the inlet port, a valve spindle guide on the valve axis, and a perforated valve cage on the valve axis downstream of the throttle cross-section and concentrically about the spindle guide in order to define a flow chamber with the spindle guide.

In accordance with the invention, a thin-walled hollow member is located between the valve cage and the spindle guide with injection ducts for directing cooling water into the flow chamber. The hollow member receives cooling water from a suitable source via a thin-walled water supply duct in the valve body for delivery into the flow chamber.

The hollow member may be in the form of a single annulus concentric to the valve axis or in the form of a plurality of annular sectors which extend around the valve axis. In either case, the hollow member is disposed between a removable cover of the valve and the valve cage while the supply duct is disposed in the cover, for example in a bore of the cover. The use of one or more thin-walled hollow members virtually obviates thermal stress cracking in the water injection ducts. Another advantage is that damage by erosion near the water injection ducts can be obviated readily by replacement of the particular hollow member concerned without any need to replace expensive parts such as the valve casing or valve cover.

These and other objects and advantages of the invention will become more apparent from the following detailed description and appended claims taken in conjunction with the accompanying drawing in which:

The drawing illustrates a cross-sectional view of a steam throttle valve constructed in accordance with the invention.

Referring to the drawing, the steam throttle valve 1 is constructed of a valve body 2 having a steam inlet port 3 and a steam outlet port 4. The valve body 2 is shaped so as to define a throttle cross-section on a valve axis intermediately of the inlet port 3 and outlet port 4. In addition, the valve has a removable cover 6 which is sealingly connected to the valve body 2 by a number of bolts 10. The bolts 10 also hold a base flange 11 of an upright 12 for a servomoter (not shown). As shown, the cover 6 forms a spindle guide 13 on the axis of the valve in which an axial passage is formed for movement of a valve spindle 15 therein.

The valve spindle 15 carries a valve head 16 which cooperates with a valve seat 18 formed on a hard metal coating or sleeve 17 on the valve body 2 adjacent the inlet port 3. In addition, a gland packing 20 is provided in the top part of the cover 6, as viewed, to seal off a gap between the spindle 15 and the spindle passage.

A substantially cylindrical perforated valve cage 30 is disposed on the valve axis downstream of the throttle cross-section concentrically about the spindle guide 13 in order to define a flow chamber therebetween. This valve cage 30 has a flange 40 which is secured by bolts 32 to a flange 27 on the cover 6. The opposite end 34 of the valve cage 30 is laterally guided in a recess 36 formed in the body 2. The middle zone of the valve cage 30 is provided with a plurality of passages 38 so as to permit a flow of steam (as indicated by the arrows 14) through the valve 1 when the valve head 16 is in an opened position.

An annular thin-walled hollow member 5 is located between the cage 30 and the spindle guide 13 near the flanges 27, 40 and has a plurality of injection ducts 8 for directing cooling water into the flow chamber between the spindle guide 13 and cage 30. The hollow member 5 extends around the spindle guide 13 and thus the valve axis. The injection ducts 8 are distributed peripherally of the member 5 and extend into the chamber between the spindle guide 13 and the cage 30 parallel to the valve axis. In addition, a water supply duct formed of two parts 7, 9 is disposed in a bore of the cover 6. As shown, one duct part 7 extends parallel to the valve axis and communicates with the hollow member 5 while the other duct part 9 extends at a right angle from the duct part 7 to merge into a flange 9' against which a head 56 of a water feed pipe 58 abuts for receiving a supply of cooling water from a suitable source (not shown). As indicated, the feed pipe 58 is laterally pressed against the flange 9' by a cross-head 60 via bolts (not shown).

The hollow member 5 is thus retained between the cover 6 and the cage 30. Accordingly, those surfaces of the cover 6 and the cage 30 which engage with the member 5 are shaped toroidally.

In operation, steam flows below the raised valve head 16 into the chamber which is inside the cage 30 and in which there is strong turbulence. Water is injected from the hollow member 5 through the ducts 8 into the steam, most of the water evaporating in the steam while a minor proportion of the water is carried along by the steam in the form of droplets through the bores 38 and possibly through the discharge port 4.

The injected water is supplied to the member 5 through a valve (not shown), line 58 and the water supply duct 9, 7. More particularly, during transient states, the water in the member 5 is at a considerably lower temperature than the steam in the valve cage chamber. However, as the member 5 is of thin-walled construction, the temperature differences do not cause damage.

Conveniently, in order to direct the streams of injected water away from the spindle guide 13 towards the valve cage 30, the water injection ducts 8, instead of extending parallel to the valve axis, can be disposed askew thereof, e.g. at an angle of 24°. For the same purpose, the ducts 8 can be arranged on helixes of equal pitch.

Instead of using a single hollow member 5 around the valve axis, two or more thin-walled hollow members can be provided each in the form of an annular sector. In this case, the members co-operate with one another to extend around the valve axis and each has a water supply duct which is engaged in a bore of the cover 6.

Further, a nozzle-like orifice can be inserted into each duct 8 to provide extended guidance in the duct direction of the issuing stream of water.

The invention thus provides a steam throttle valve which can be constructed in a relatively simple manner so as to avoid thermal stress cracking in the water injection ducts.

What is claimed is:

1. A steam throttle valve comprising a valve body having a steam inlet port and a throttle cross-section disposed on a valve axis downstream of said inlet port;

a valve spindle guide disposed on said valve axis;

a perforated valve cage disposed on said axis downstream of said throttle cross-section and concentrically about said spindle guide to define a flow chamber therebetween;

a thin-walled hollow member between said valve cage and said spindle guide and having injection ducts for directing cooling water into said flow chamber; and a thin-walled water supply duct in said body for receiving cooling water and being in communication with said hollow member to deliver cooling water into said hollow member for injection into said flow chamber.

2. A steam throttle valve as set forth in claim 1 wherein said hollow member is an annulus concentric to said valve axis.

3. A steam throttle valve as set forth in claim 2 which further comprises a removable cover on said body and wherein said annulus is mounted between said cover and said valve cage.

4. A steam throttle valve as set forth in claim 3 wherein said supply duct is disposed in said cover.

5. A steam throttle valve as set forth in claim 1 which includes a plurality of said hollow members and each said member is an annular sector.

6. A steam throttle valve as set forth in claim 5 which further comprises a removable cover on said body and wherein said annular sector is mounted between said cover and said valve cage.

7. A steam throttle valve as set forth in claim 6 wherein said supply duct is disposed in said cover.

8. A steam throttle valve as set forth in claim 1 which further comprises a removable cover on said body integral with said spindle guide and removably secured to said valve cage.

9. A steam throttle valve as set forth in claim 1 wherein said injection ducts are disposed at an outwardly directed angle from said valve axis to direct injected water towards said valve cage.

* * * * *